US005137204A

United States Patent [19]

Compagnucci

[11] Patent Number: 5,137,204

[45] Date of Patent: Aug. 11, 1992

[54] AUTOMATIC AND CONTINUOUS MANUFACTURING PROCESS FOR REELS MADE OF METAL ROD

[75] Inventor: Rossano Compagnucci, Osimo, Italy

[73] Assignee: Compagnucci - S.p.A., Italy

[21] Appl. No.: 734,277

[22] Filed: Jul. 22, 1991

[30] Foreign Application Priority Data

Jul. 27, 1990 [IT] Italy ..... 626 A/90

[51] Int. Cl.[5] ..... B65H 75/20; B65H 75/50

[52] U.S. Cl. ..... 228/173.4; 228/182; 242/77.2; 242/86.4

[58] Field of Search ..... 228/173.4, 182; 242/77.2, 86, 86.2, 86.4

[56] References Cited

U.S. PATENT DOCUMENTS 300,355 6/1884 Gardner ..... 242/86.4

358,953 3/1887 Wirt ..... 242/86.4

1,451,745 4/1923 Sommer ..... 242/77.2

3,544,031 12/1970 White ..... 242/77.2 X

*Primary Examiner*—Kenneth J. Ramsey

*Attorney, Agent, or Firm*—Leonard Bloom

[57] ABSTRACT

The object of the present invention is an industrial process for automatically and continuously manufacturing reels for holding coils of wire.

In the manufacturing process according to the invention, finished reels leave a shaping and assembly line along which their various transverse spokes are shaped and welded one at a time to two straight metal rods that are forward fed in precisely regular and intermittent strokes, and are progressively bent so that, after a certain number of strokes, their ends meet and they form a regular polygon.

3 Claims, 1 Drawing Sheet

AUTOMATIC AND CONTINUOUS MANUFACTURING PROCESS FOR REELS MADE OF METAL ROD

FIELD OF THE INVENTION

The object of the present patent application is an industrial process for automatically and continuously manufacturing reels for holding coils of wire, particularly metal wire for welding machines.

BACKGROUND OF THE INVENTION

In the past, disposable moulded plastic reels have been used for this purpose, however, they have been seen to be poorly suited to the task, partly due to their lack of mechanical resistance, but mostly because of the environmental pollution problems connected with them due to the well known difficulty of disposing of plastic waste products.

For these reasons, plastic reels fell into disuse once reels exclusively constructed from pieces of metal rod arc-welded together appeared.

These metal reels have a skeleton like structure consisting of a central hub and two circular sides that hold in the wire wound around the central hub.

The hub generally takes the form of a cylindrical cage on a horizontal axis. The bars forming this cage are 'U' shaped. The central sections of the bars are parallel to this axis, and the ends of the bars form a series of parallel radial spokes positioned opposite each other and welded to two rims that, together with the spokes, form the two sides of the reel.

The manufacturing process for the reels in question requires the preparation of a number of spokes, by repeatedly cutting lengths of metal rod and bending them in suitable presses, and preparing a number of rims by repeatedly cutting lengths of similar metal rod and welding the ends together once they have been bent into a ring using suitable equipment.

The assembly of the components requires the use of special welding machines that are capable of simultaneously holding and welding all the transverse spokes to the two side rims.

The scope of the present invention is that of making the manufacturing process of these metal rod reels more economical by replacing the current manufacturing method which has two distinct stages: the preparation of the single components, and their assembly.

SUMMARY OF THE INVENTION

In the manufacturing process according to the invention, these two stages no longer take place, as the finished reel leaves an assembly and shaping line along which the transverse spokes are formed one at a time and welded one at a time to two parallel straight metal rods that are fed forward in precisely regular steps, and which are progressively bent until, after a set number of strokes, their ends meet and the rods form a regular polygon.

In particular, as reels with eight transverse spokes are to be manufactured, the aforementioned pair of parallel metal rods is fed forward reach time by a distance that is precisely equal to one eighth of the perimeter of the sixteen-sided regular polygon that the two metal rods form after having been bent sixteen times in an identical fashion.

On the route along which the two aforementioned rods are fed, there are two operating stations. The first station automatically cuts, bends, and welds each of the transverse spokes, by measuring and cutting a length from a straight metal rod that is intermittently fed above and at right angles to the aforementioned pair of parallel metal rods. Each time the pair of metal rods stops moving, they are both simultaneously bent at the second station, and, after being bent sixteen times, they take up the closed form of a regular sixteen-sided polygon.

For improved clarity, the description of the invention continues with reference to the attached drawings, which merely illustrate the invention and do not limit it, in which:

DESCRIPTION OF THE PREFERRED EMBODIMENTS

Figure 1:
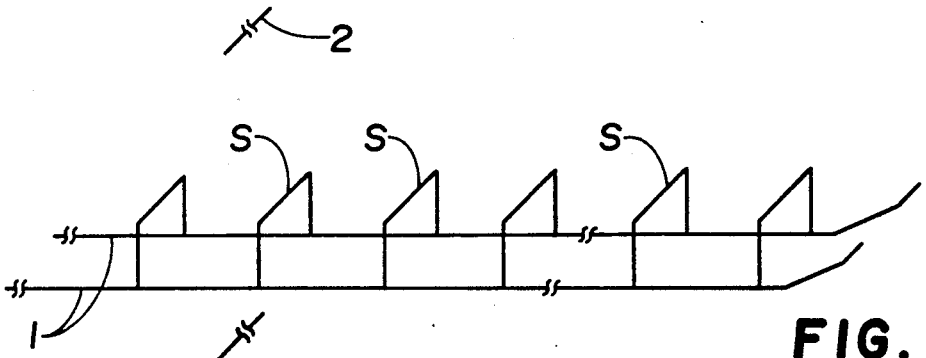
FIGS. 1, 2, 3, and 4 are schematic views of successive stages of the manufacturing process according to the invention.
Figure 2:
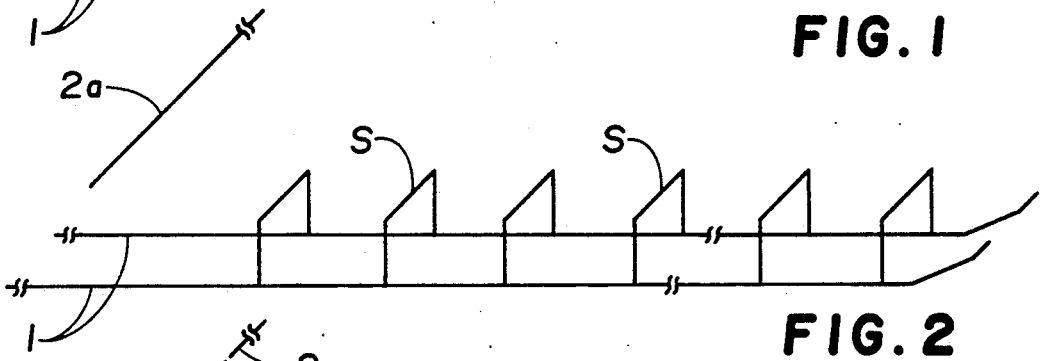
Figure 3:
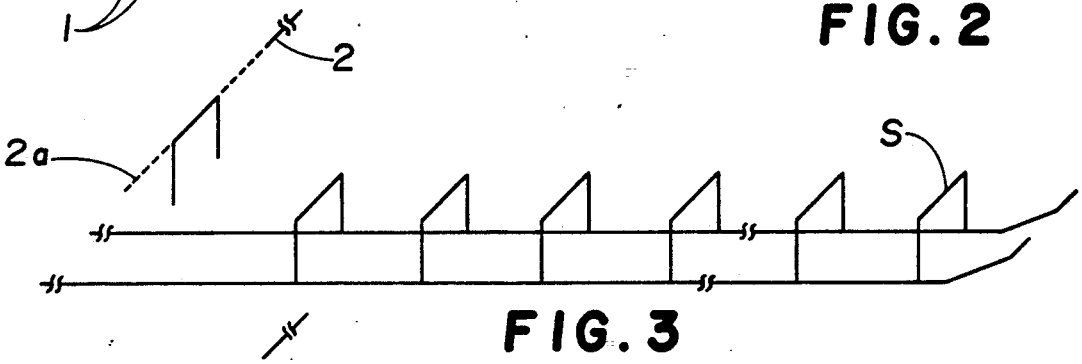
Figure 4:
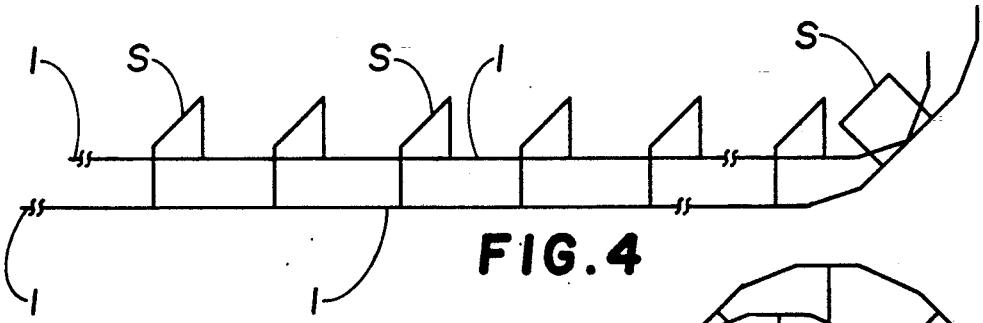
Figure 5:
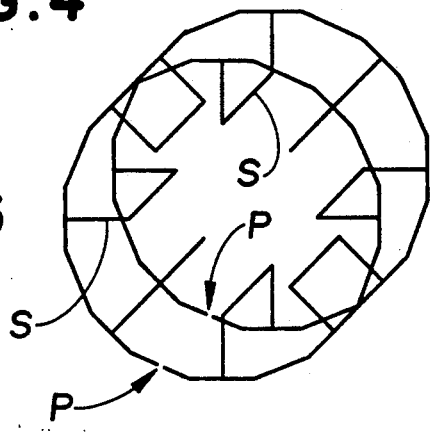
FIG. 5 is an axonometric view of the reel obtained via the process according to the invention.

With reference to the aforementioned figures, the manufacturing process involves the use of a pair of metal rods (1) that are automatically unwound from their respective reels and fed forward parallel to each other along a work surface by normal and known means and systems, that are not shown in the figures for this reason.

This pair of rods (1) is fed forward intermittently, and the length of each stroke is precisely equal to a whole submultiple of the length of the perimeter of the regular polygon formed by these rods (1) following their repeated bending until their ends meet.

In particular, this submultiple corresponds to the number of transverse spokes (S) on each reel (R). In the example shown, each movement stroke of the rods (1) is equal to one eighth of the aforementioned perimeter, as there are eight spokes to be added to the reel.

The process also requires the use of a third metal rod (2) placed above and at right angles to the pair of rods (1), and automatically unwound from a respective reel by similarly conventional equipment.

The transverse feed of this third rod (2) is also intermittent, and the length of the stroke is precisely equal to the length of each spoke (S).

Lengths (2*a*) are cut from this third rod (2) that are equal in length to each spoke (S).

At the same time as these lengths of rod (2*a*) are cut, they are bent into the 'U' shape of the spokes (S).

While the pair of rods (1) are stationary, the spokes (S) are automatically welded onto the rods (1), in such a way that the lower end of each of the vertical arms of each single spoke (S) is placed on one of the two rods (1).

Whilst the rods (1) are stationary, a second production station downhill from the spoke (S) welding station simultaneously bends the two rods (1) in such a way that, after a certain number of bends, the rods form a regular polygon with twice the number of sides as there are spokes (S) (there are sixteen sides and eight spokes in the example shown).

The reason for this particular ratio between the number of spokes (S) and the number of sides of the polygon is that the closure point (P) for each of the rods (1) can then fall in the centre of one of the sides of the polygon instead of at one of the angles, thus making it easier both to cut the rod (1) and weld its ends together when they meet.

To be more precise, at each forward feed stroke of the rods (1), the second station carries out two bends at the same time, given that the number of sides must be twice that of the number of spokes (S) on each reel (R), for the above mentioned reason.

I claim:

1. Process for the automatic and continuous manufacture of reels made of metal rod comprising the steps of: unwinding two respective supply reels to provide two parallel straight metal rods, each rod having a first end; intermittently feeding said metal rods forward along a work surface; forming a U-shaped transverse spoke of metal rod, the U-shaped spoke having a length and a pair of arms, each arm having an end thereon; holding the parallel straight metal rods momentarily stationary and concurrently placing the U-shaped spokes in a transverse position wherein the ends of the arms of the U-shaped spoke are each touching a respective parallel straight metal rod; welding the respective ends of the arms of the U-shaped spoke to the respective parallel straight metal rods; vertically bending each of the parallel straight metal rods having the U-shaped spoke welded thereto through two successive angular bends, the bends being at the same angle; advancing the two parallel straight metal rods a predetermined distance and repeating the above steps of forming and welding the U-shaped spoke to the parallel straight metal rods and vertically bending the straight metal rods, wherein the rods take up the form of a regular polygon whose number of sides is twice that of the number of spokes, and the ends of the respective parallel rods are in contact with the straight parallel rod at the respective supply reel; cutting the parallel straight metal rods to form a respective second end; welding the respective first end to the respective second end of the parallel metal rods such that a reel is formed having the shape of a regular polygon with twice the number of sides as the number of spokes on the wheel.

2. The process of claim 1, further comprising the steps of providing a supply reel having a metal rod wound thereon, automatically unwinding from the supply reel a length of metal rod equal to the length of the U-shaped spoke, placing the length of metal rod above and at right angles to the two parallel straight metal rods, bending the length of metal rod to form the U-shaped spoke, cutting the metal rod whereby the U-shaped metal spoke is separated from the metal rod, intermittently feeding forward the length of metal rod to permit forming of additional U-shaped spokes.

3. A reel made of metal rod obtained using the process of claim 1.

* * * * *